US007371048B2

(12) United States Patent
Downs et al.

(10) Patent No.: US 7,371,048 B2
(45) Date of Patent: May 13, 2008

(54) TURBINE BLADE TRAILING EDGE CONSTRUCTION

(75) Inventors: James P. Downs, Jupiter, FL (US); Norman F. Roeloffs, Tequesta, FL (US); Edward Pietraszkiewicz, Southington, CT (US); David Michael Kontrovitz, Manchester, CT (US); Takao Fukuda, East Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 378 days.

(21) Appl. No.: 11/140,631

(22) Filed: May 27, 2005

(65) Prior Publication Data

US 2006/0269419 A1 Nov. 30, 2006

(51) Int. Cl.
*F01D 5/18* (2006.01)

(52) U.S. Cl. ..... 416/97 R

(58) Field of Classification Search ..... 415/115, 415/116; 416/96 R, 96 A, 97 R
See application file for complete search history.

(56) References Cited

U.S. PATENT DOCUMENTS 4,303,374 A * 12/1981 Braddy ..... 416/97 R
5,246,341 A 9/1993 Hall et al.
5,342,172 A * 8/1994 Coudray et al. ..... 416/97 R
5,368,441 A * 11/1994 Sylvestro et al. ..... 416/97 R
5,503,529 A 4/1996 Anselmi et al.
5,614,294 A 3/1997 Downs et al.
5,688,107 A 11/1997 Downs et al.
6,050,777 A 4/2000 Tabbita et al.
6,164,912 A 12/2000 Tabbita et al.
6,210,112 B1 4/2001 Tabbita et al.
6,247,896 B1 6/2001 Auxier et al.
6,280,140 B1 8/2001 Soechting et al.
2006/0222496 A1 * 10/2006 Lee et al. ..... 416/97 R

FOREIGN PATENT DOCUMENTS

EP 1 213 442 A1 6/2002

* cited by examiner

*Primary Examiner*—Christopher Verdier

(57) ABSTRACT

A turbine blade system for a gas turbine engine includes a turbine blade having a trailing edge region extending in a lateral direction and in a lengthwise direction from a pressure side surface to a trailing edge. The trailing edge region includes a plurality of riblets extending in the lengthwise direction from the pressure side surface toward the trailing edge. The trailing edge region defines a plurality of ejection slots each laterally disposed between two of the riblets. The plurality of riblets each define an upper surface having at least a portion in the lengthwise direction being curved relative to the pressure side surface so as to generally shield the upper surface from a high heat load propagating from the pressure side surface and to facilitate cooling air flowing from the ejection slots to flow over the upper surface.

10 Claims, 2 Drawing Sheets

TURBINE BLADE TRAILING EDGE CONSTRUCTION

FIELD OF THE INVENTION

This invention relates generally to turbine blades for gas turbine engines, and more particularly to the configuration of the turbine blades for cooling the trailing edge region thereof.

BACKGROUND OF THE INVENTION

The trailing edge regions of turbine blades are often cooled by discharging spent cooling air through an array of holes or slots, which intersect and connect an internal cooling circuit and the external surface of the airfoil near the trailing edge region. The method of cutting back the pressure side to permit discharge of coolant to the pressure side of the airfoil is commonly referred to as "pressure side bleed". In this system, cooling air is discharged from the pressure side, just upstream of the trailing edge, through an array of cooling holes, or ejection slots. The cooling holes are typically separated by solid features, which are hereinafter referred to as "riblets". The current art includes riblets that form straight cooling passages and "diffusing" riblets that include an angle so that coolant can expand and spread to provide an increasing film cooling effect on the exposed trailing edge features. Examples of the current art can be found in U.S. Pat. No. 5,503,529, European Patent EP 1213442 and U.S. Pat. No. 5,246,341.

The current method of forming riblets typically involves a combination of casting and machining operations. The surface features inside the slot are typically a product of the casting process and are therefore called as-cast surfaces. The casting process typically leaves additional stock on the top of the lands, and also on the pressure side surface just forward of the pressure side bleed location. This material is typically removed following the casting process with both the aft pressure side and land top surfaces brought to the desired profile using an abrasive media.

With reference to FIGS. 1, 2A and 2B, an example of a turbine blade for a gas turbine engine illustrating such a cooling arrangement is indicated generally by the reference number 10. The blade 10 includes a plurality of ejection slots 12 and riblets 14 disposed along a trailing edge region of the blade. A conventional pressure side bleed slot geometry is illustrated in the enlarged views of FIGS. 2A and 2B. A problem to be solved involves cooling of the trailing edge region of a turbine blade using the pressure side bleed feature. In the current state of the art, coolant ejected from the pressure side bleed arrangement provides a cooling effect upon the surfaces contained within an ejection slot 12, while hot gas conditions from the pressure side of a blade and flowing along a pressure side surface 16 prevail on an upper or land surface 18 on the top of a riblet 14. Since the hot gas conditions exposed to the land surface 18 on the top of a riblet 14 can represent an extraordinary heat load, the ability to effectively cool the trailing edge region can be limited.

Accordingly, it is an object of the present invention to provide a turbine blade trailing edge configuration that overcomes the above-mentioned drawbacks and disadvantages.

SUMMARY OF THE INVENTION

In a first aspect of the present invention, a turbine blade system for a gas turbine engine includes a turbine blade having a trailing edge region extending in a lateral direction and in a lengthwise direction from a pressure side surface to a trailing edge. The trailing edge region includes a plurality of riblets extending in the lengthwise direction from the pressure side surface toward the trailing edge. The trailing edge region defines a plurality of ejection slots each laterally disposed between two of the riblets. The plurality of riblets each define an upper surface having at least a portion in the lengthwise direction being curved relative to the pressure side surface so as to generally shield the upper surface from a high heat load propagating from the pressure side surface and to facilitate cooling air flowing from the ejection slots to flow over the upper surface.

In a second aspect of the present invention, a turbine blade system for a gas turbine engine includes a turbine blade having a trailing edge region extending in a lateral direction and in a lengthwise direction from a pressure side surface to a trailing edge. The trailing edge region includes a plurality of riblets extending in the lengthwise direction from the pressure side surface toward the trailing edge. The trailing edge region defines a plurality of ejection slots each laterally disposed between two of the riblets. The plurality of riblets each define an upper surface having at least a portion in the lengthwise direction being generally inwardly concavely curved relative to the pressure side surface so as to generally shield the upper surface from a high heat load propagating from the pressure side surface and to facilitate cooling air flowing from the ejection slots to flow over the upper surface.

In a third aspect of the present invention, a turbine blade system for a gas turbine engine includes a turbine blade having a trailing edge region extending in a lateral direction and in a lengthwise direction from a pressure side surface to a trailing edge. The trailing edge region includes a plurality of riblets extending in the lengthwise direction from the pressure side surface toward the trailing edge. The trailing edge region defines a plurality of ejection slots each laterally disposed between two of the riblets. The plurality of riblets each define an upper surface having at least a portion in the lengthwise direction being inwardly concavely curved relative to the pressure side surface so as to generally shield the upper surface from a high heat load propagating from the pressure side surface and to facilitate cooling air flowing from the ejection slots to flow over the upper surface. The upper surface associated with each of the plurality of riblets has at least a portion in the lateral direction being generally convexly curved so as to further facilitate cooling air flowing from the ejection slots to flow over the upper surface.

DETAILED DESCRIPTION OF THE PREFERRED EMBODIMENTS

Figure 3A:
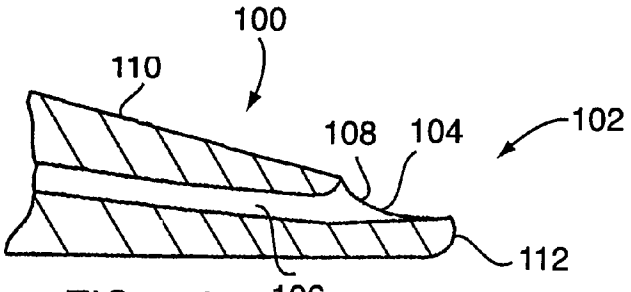
FIG. 3A is an enlarged elevational view of a portion of a turbine blade showing an ejection slot and riblet in accordance with the present invention.
Figure 3B:
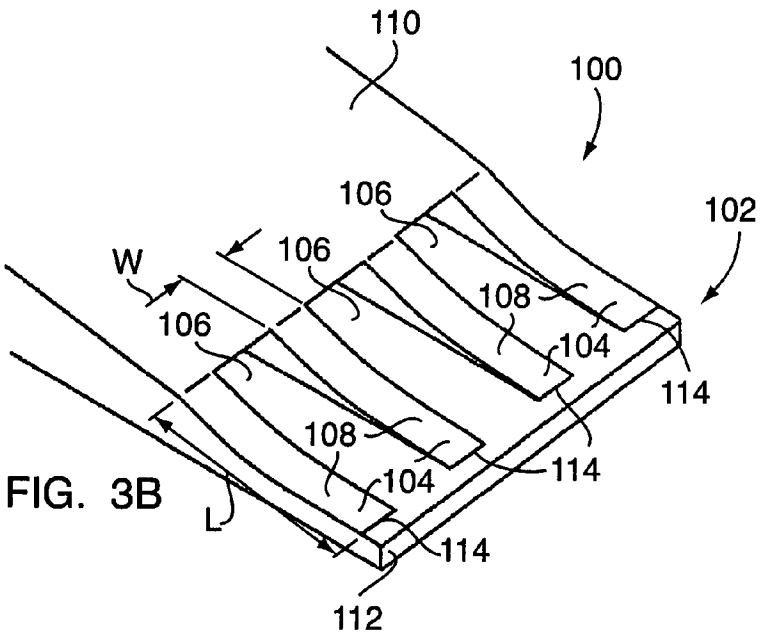
FIG. 3B is a perspective view of the portion of the turbine blade of FIG. 3A.

Referring to FIGS. 3A and 3B, a turbine blade embodying the present invention is indicated generally by the reference number 100. The turbine blade 100 has a trailing edge region 102 which includes a plurality of riblets 104, and defines a plurality of ejection slots 106. The riblets 104 each have an upper or land surface 108 having a length "L" and a width "W". As shown in FIG. 3B, the riblets 104 each extend in a lengthwise direction from a pressure side surface 110 of the blade 100 toward a trailing edge 112 of the blade. The riblets 104 each terminate at a longitudinal end 114 located slightly inwardly from the trailing edge 112. As shown in FIG. 3B, each of the ejection slots 106 is disposed between two of the riblets 104.

The turbine blade 100 has an optimum geometry of the riblets 104 so that cooling can be accomplished in the most efficient manner while maintaining the structural capability of the trailing edge region 102. To accomplish this objective, the land surface 108 of each of the riblets 104 is inwardly contoured or curved in relation to the pressure side surface 110 disposed upstream of the riblets 104 relative to the direction of airflow. Specifically, the land surfaces 108 of the riblets 104 are each inwardly contoured or curved in the lengthwise direction from the pressure side surface 110 toward the trailing edge 112 of the blade 100 in order to shield the land surfaces 108 from the high heat load propagating from the pressure side of the turbine blade and to facilitate the flow or washing of cooling air over the land surfaces, thereby providing a film cooling effect of the land surfaces. As also shown in FIG. 3B, each differential segment of a land surface 108 associated with a riblet 104 extending in the widthwise or lateral direction has a profile which is generally flat or linear. Fabrication of contours or curves of the land surfaces 108 can be accomplished using, for example, a modification of the existing material removal by abrasive media process, or by a separate machining process such as electrical-discharge-machining (EDM).

Figure 2A:
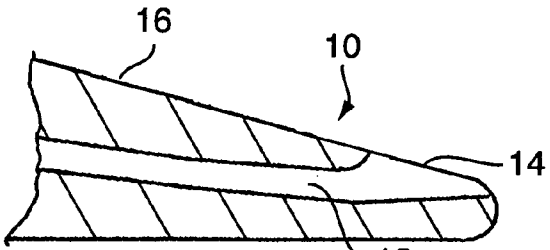
FIG. 2A Prior Art
FIG. 2A is an enlarged elevational view of a portion of a conventional blade showing an ejection slot and riblet.
Figure 2B:
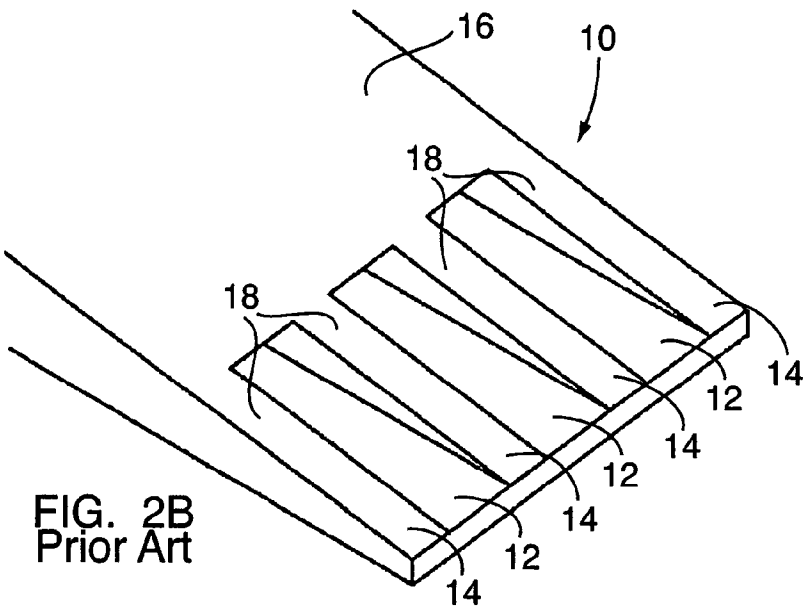
FIG. 2B Prior Art
FIG. 2B is a perspective view of the portion of the turbine blade of FIG. 2A.
Figure 1:
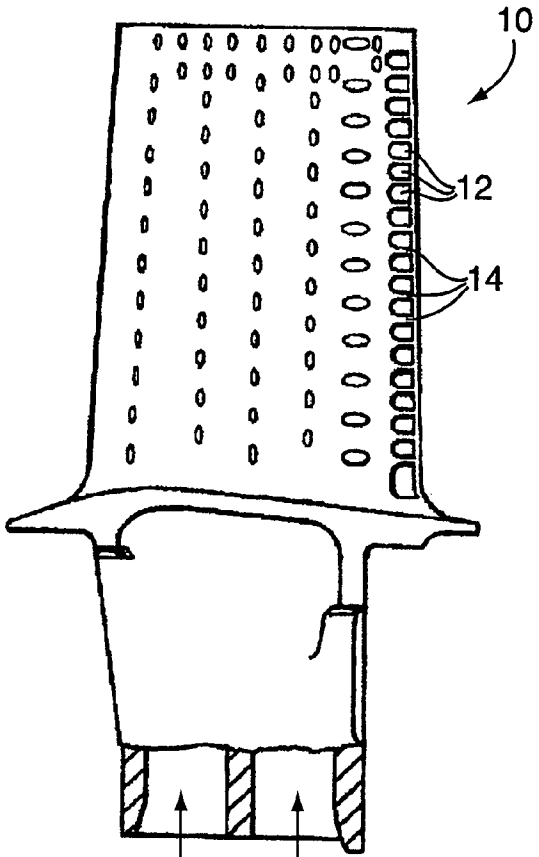
FIG. 1 Prior Art
FIG. 1 is an elevational, partly sectional view of an exemplary turbine blade for a gas turbine engine having an airfoil with a plurality of ejection slots and riblets.
Figure 4A:
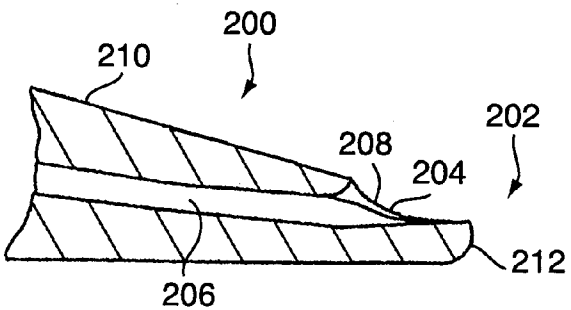
FIG. 4A is an enlarged elevational view of a portion of a turbine blade showing an ejection slot and riblet in accordance with a second embodiment of the present invention.
Figure 4B:
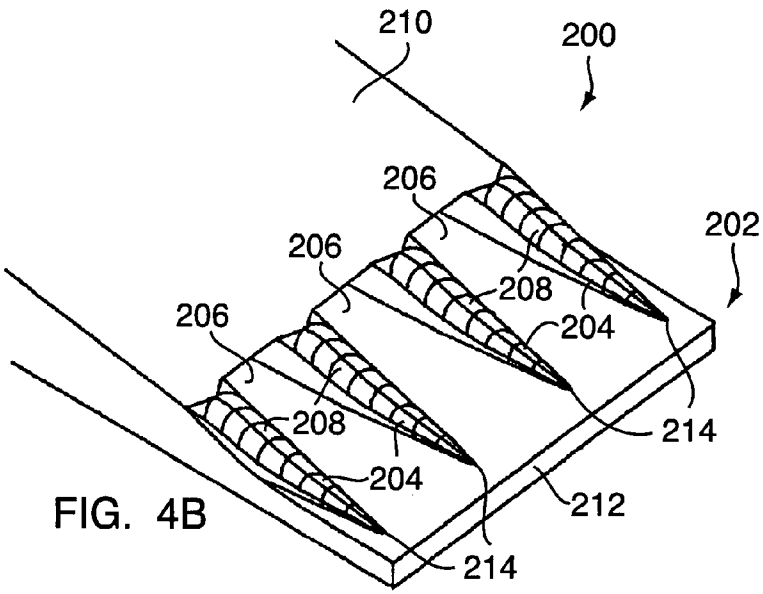
FIG. 4B is a perspective view of the portion of the turbine blade of FIG. 4A.

Referring to FIGS. 4A and 4B, a turbine blade in accordance with a second embodiment of the present invention is indicated generally by the reference number 200. A trailing edge region 202 of the turbine blade 200 is generally the same as that of the turbine blade 100 of FIGS. 3A and 3B, except that each differential segment of a land surface 208 associated with a riblet 204 extending in the widthwise or lateral direction has a profile which is convexly curved or otherwise contoured to further promote the spreading of cooling airflow ejected from ejection slots 206 on top of the land surfaces 208. The turbine blade 200 also differs from the turbine blade 100 in that the width of each riblet 204 progressively narrows in a direction from the pressure side surface 210 toward a trailing edge 212. As shown in FIG. 4B, for example, the width of each riblet 204 converges to a point at a longitudinal end 214 at a location slightly inwardly of the trailing edge 212 of the turbine blade 200.

Fabrication of the curved land surfaces 208 on top of the riblets 204 can be accomplished as part of the casting process, or can be machined. Abrasive media finish of some features can continue to be used to remove excess material, such as that normally cast onto the pressure side wall near the trailing edge, which is typically used to facilitate the casting process.

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

What is claimed is:

1. A turbine blade system for a gas turbine engine, the turbine blade system comprising a turbine blade having a trailing edge region extending in a lateral direction and in a lengthwise direction from a pressure side surface to a trailing edge, the trailing edge region including a plurality of riblets extending in the lengthwise direction from the pressure side surface toward the trailing edge, the trailing edge region defining a plurality of ejection slots, each laterally disposed between two of the riblets, the riblets each having an upper surface comprising an extension of said pressure side surface, said extension being external of said turbine blade, each said upper riblet surface having a substantial portion thereof in the lengthwise direction which is of increased curvature relative to the pressure side surface wherein the upper surface of each said riblet is shielded from a high heat load propagating from the pressure side surface and wherein the flow of cooling air flowing from the ejection slots over the upper surface of each said riblet is facilitated.

2. A turbine blade system as defined in claim 1, wherein the upper surface associated with each of the plurality of riblets includes differential segments which are generally flat or linear in the lateral direction.

3. A turbine blade system as defined in claim 2, wherein the plurality of riblets each extend in the lengthwise direction from a first end adjacent to the pressure side surface to a second end located inwardly of the trailing edge.

4. A turbine blade system as defined in claim 1, wherein each of the upper surfaces associated with the plurality of riblets has at least a portion thereof in the lateral direction which is curved so as to further facilitate cooling air flowing from the ejection slots over the upper surfaces.

5. A turbine blade system as defined in claim 1, wherein each said portion of said upper surface of increased curvature associated with each of the plurality of riblets is inwardly curved relative to the pressure side surface.

6. A turbine blade system as defined in claim 1, wherein the upper surface associated with each of the plurality of riblets has at least a portion in the lengthwise direction being generally concavely curved relative to the pressure side surface.

7. A turbine blade system as defined in claim 1, wherein each of the upper surfaces associated with the plurality of riblets has at least a portion in the lateral direction which is generally convexly curved so as to further facilitate cooling air flowing from the ejection slots over the upper surfaces.

8. A turbine blade system as defined in claim 7, wherein the plurality or riblets each have a width progressively decreasing in the lengthwise direction from the pressure side surface toward the trailing edge.

9. A turbine blade system as defined in claim 7, wherein the plurality of riblets each have a width progressively decreasing in the lengthwise direction from the pressure side surface toward the trailing edge such that the width converges to a point at a location slightly inwardly of the trailing edge.

10. A turbine blade system for a gas turbine engine, the turbine blade system comprising a turbine blade having a trailing edge region extending in a lateral direction and in a lengthwise direction from a pressure side surface to a trailing edge, the trailing edge region including a plurality of riblets extending in the lengthwise direction from the pressure side surface toward the trailing edge, the trailing edge region defining a plurality of ejection slots each laterally disposed between two of the riblets, the plurality of riblets each defining an upper surface comprising an extension of said pressure side surface, said upper riblet surfaces each having at least a substantial portion thereof in the lengthwise direction which is inwardly concavely curved relative to the pressure side surface wherein the upper surfaces of said riblets are shielded from a high heat load propagating from the pressure side surface and wherein the flow of cooling air flowing from the ejection slots over the upper surfaces is facilitated, and wherein the upper surface associated with each of the plurality of riblets has at least a substantial portion thereof in the lateral direction being generally convexly curved so as to further facilitate cooling air flowing from the ejection slots over the upper surfaces.

* * * * *